United States Patent [19]

Sharber et al.

[11] 4,433,499

[45] Feb. 28, 1984

[54] COPY HOLDER WITH MOTOR DRIVEN LINE GUIDE

[75] Inventors: Jerry L. Sharber, Toledo; Ronald E. McNeal, Wapakoneta, both of Ohio

[73] Assignee: Sheller Globe, Toledo, Ohio

[21] Appl. No.: 509,588

[22] Filed: Jun. 29, 1983

Related U.S. Application Data

[63] Continuation of Ser. No. 206,867, Nov. 14, 1980, abandoned.

[51] Int. Cl.[3] ..... B41J 11/64

[52] U.S. Cl. ..... 40/356; 40/466

[58] Field of Search ..... 40/343, 352, 356, 466; 116/240; 33/448

[56] References Cited

U.S. PATENT DOCUMENTS

| | | | |
|---|---|---|---|
| 640,347 | 1/1900 | Winslow | 40/356 |
| 1,033,288 | 7/1912 | Stavens | 40/356 |
| 1,616,854 | 2/1927 | Hunt | 40/356 |
| 1,723,332 | 8/1929 | Day et al. | 116/240 |
| 1,905,834 | 4/1933 | Fensky | 40/356 |
| 2,763,241 | 9/1956 | Waggoner | 40/352 |
| 3,030,924 | 3/1960 | Friis-Hansen | 40/356 |
| 3,449,849 | 6/1969 | Pasquale et al. | 40/343 |
| 3,449,850 | 6/1969 | Eckert | 40/349 |
| 3,763,989 | 10/1973 | Goldman | 40/343 |
| 4,043,064 | 8/1977 | Friedman | 40/343 |
| 4,132,019 | 1/1979 | Wegner et al. | 40/356 |
| 4,195,429 | 4/1980 | Wegner | 40/356 |

*Primary Examiner*—John J. Wilson

*Attorney, Agent, or Firm*—Fraser, Barker, Purdue & Clemens

[57] ABSTRACT

An electrically controlled copy holder includes a face plate defining a copy support surface and a line guide extending across the face plate and slideably mounted adjacent one vertical edge of the face plate, for vertical sliding movement along the copy support surface. The line guide is attached to a motor driven endless belt mounted in a housing on the opposite side of the face plate. Electric control means are provided for maintaining the motor energized for an adjustable interval, and hence for moving the line guide a pre-selected distance.

6 Claims, 6 Drawing Figures

COPY HOLDER WITH MOTOR DRIVEN LINE GUIDE

This is a continuation of application Ser. No. 206,867, filed 11/14/80, now abandoned.

BACKGROUND OF THE INVENTION

The invention relates to an improved typist's copy holder having a motor driven line guide. Copy holders include a face plate which provides a supporting surface for the copy matter, or document to be copied; a brace support member to hold the face plate in an appropriate inclined position; and a line guide adapted to extend transversely across the copy matter. In the typical manual copy holder, the line guide is magnetically mounted on the face plate and is manually advanced, or slided downwardly, a line at a time, by the typist. However, moving the line guide manually is time consuming, as it requires the typist to remove at least one hand from the typewriter keys.

To increase typing efficiency, copy holders have been designed having motor driven line guides actuated by either a foot switch or by the typewriter carriage return. U.S. Pat. No. 4,195,429 describes a copy holder with a motor driven line guide. The apparatus includes a flat, flexible, metal drive belt. The line guide is magnetically attached to the drive belt. The magnetic attachment drivingly connects the belt and line guide, and maintains proper alignment of the line guide. However, it is undesirable to have magnets near some common office electronic equipment.

A design problem with electrically driven line guides has been assuring that the line guide moves the appropriate distance each time the motor is activated. Mechanical control means, such as cam operated microswitches, have been employed to deactivate the motor when the line guide moves the required distance. In other designs, it has simply been left to the typist to control the distance which the line guide advances by maintaining the foot switch closed for the necessary time interval. There is obviously a need for a simple, reliable copy holder in which the line guide is automatically advanced a preselected distance upon operation of control means.

SUMMARY OF THE INVENTION

It is accordingly an object of the invention to provide a copy holder having a motor driven line guide which is operable to be automatically advanced a pre-selected distance. For such automatic operation, the motor is operable by electronic switching means, adjustable to keep the motor energized during the time necessary to advance the line guide a pre-selected distance.

It is another object of the invention to provide a motor driven line guide including an endless drive belt, and simple, reliable attachment of the line guide to the drive belt.

It is a further object of the invention to provide a copy holder in which the motor and associated drive train are mounted in a housing provided as a subassembly unit.

The invention includes an endless drive belt behind the face plate, running adjacent one edge of the plate from top to bottom. A line guide holder is mounted on the front of the face plate adjacent this edge, for sliding, vertical movement. The holder includes a bracket extending behind the plate to grip the drive belt with resilent tines. The drive belt and associated pulleys, motor, and gear box, are mounted in a housing, providing a drive subassembly to be fixed to the back of the face plate.

In the preferred embodiment, the copy holder includes electronic time delay circuitry which energizes the drive motor for a predetermined time after a control switch is momentarily closed, then reopened, such that the line guide is advanced the desired distance. A variable resistor is used to control the discharge rate of a capacitor in the timing circuitry, thus determining the appropriate delay interval.

BRIEF DESCRIPTION OF THE DRAWINGS

The above objects and advantages of the invention will become readily apparent to one skilled in the art from reading the following detailed description of an embodiment of the invention when considered in light of the accompanying drawings.

DESCRIPTION OF THE PREFERRED EMBODIMENT

Figure 1:
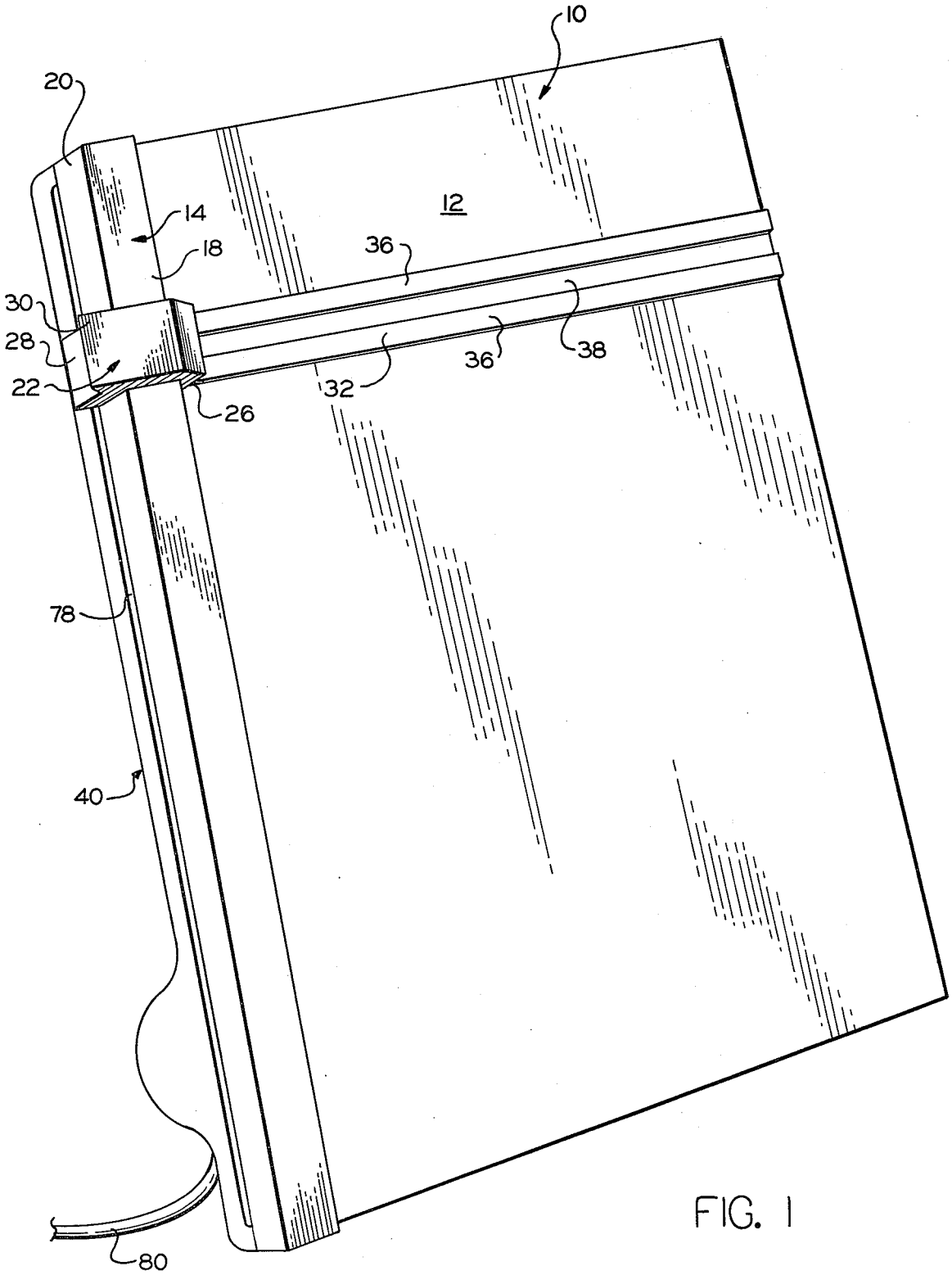
FIG. 1 is a front perspective view of a copy holder embodying the present invention.
Figure 2:
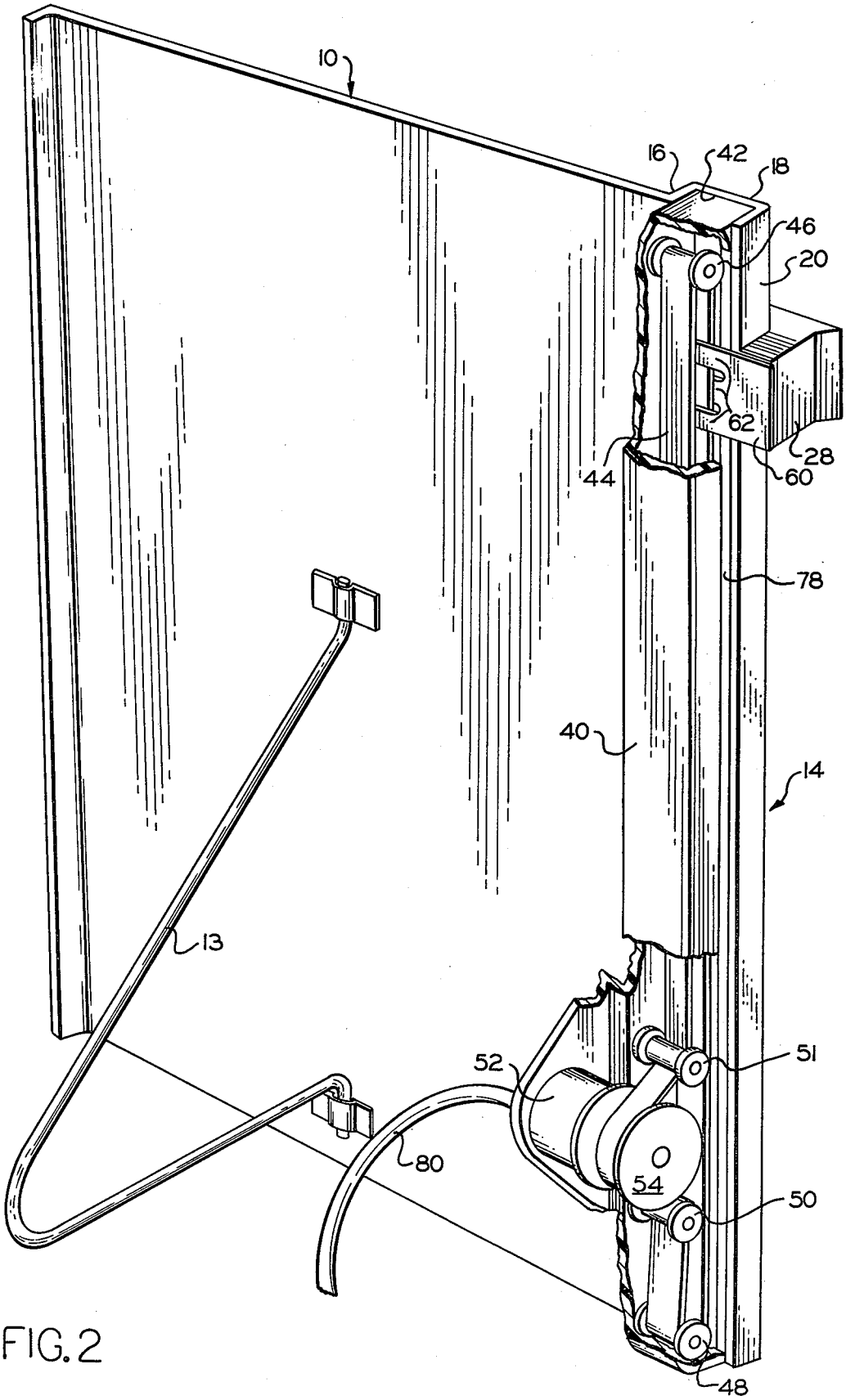
FIG. 2 is a rear perspective view of the copy holder of FIG. 1, with portions cut away to show the drive mechanism.

In FIGS. 1 and 2 is illustrated a copy holder according to the present invention, in perspective view. The copy holder comprises a face plate 10 fabricated from sheet metal, for example. The face plate 10 includes a flat paper support surface 12, for supporting copy sheets containing matter to be copied. A copy sheet is typically held in place by a magnitized bar placed over the sheet. A brace member 13 is pivotally attached to the rear of the face plate 10 (FIG. 2), and adapted to support the face plate 10 in a generally vertical, somewhat inclined position.

At one vertical side, the face plate 10 is bent outwardly to form a track 14 which extends from the top to the bottom of the face plate 10 and is parallel to the vertical edges of the support surface 12. The projecting track 14 comprises an outwardly extending wall 16 perpendicular to the paper supporting surface 12, a wall 18 parallel to the support surface 12, and a rearwardly projecting wall 20 perpendicular to the supporting surface 12. The track 14 thus has a right angled U-shaped cross section, as clearly illustrated in FIGS. 1 and 2.

The track 14 supports a line guide holder 22 for vertical, sliding movement along the side of the face plate 10. The line guide holder 22 is also generally U-shaped, and includes a rectangular slot 24 adapted to slidingly fit over the track 14. Two legs 26 and 28, defining the slot 24, engage the walls 16 and 20, respectively, of the track 14. A handle 30 may be provided on the line guide holder 22, to facilitate manual movement of the line guide.

Figure 3:
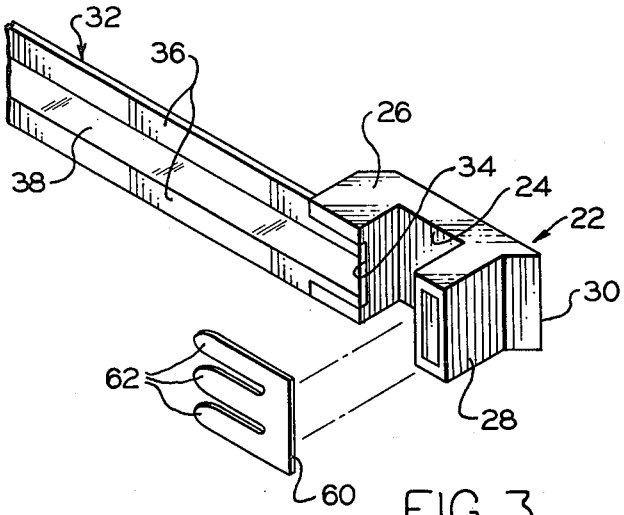
FIG. 3 is an exploded view of the line guide and line guide holder.
Figure 5:
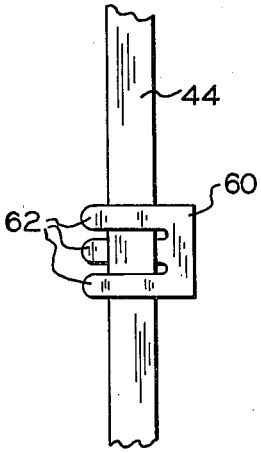
FIG. 5 is a perspective view illustrating in detail the attachment of the drive belt and the line guide bracket.

A line guide 32 is attached in any conventional manner to the line guide holder 22, or may be manufactured as an integral part of the line guide holder 22. In the preferred embodiment, the line guide 32 is separately formed of a transparent thermoplastic material, for example, then press fitted and cemented in a groove 34 formed in the inner leg 26 of the line guide holder 22 (FIG. 3). The line guide 32 extends from the line guide holder 22 across the paper support surface 12 to the opposite edge of the face plate 10. The sliding engagement of the line guide holder 22 with the track 14 assures continuous alignment of the line guide 32 as it is moved along the support surface 12.

In order to highlight the appropriate line of the copy material, the line guide 32 may include upper and lower amber tinted portions 36, surrounding a central clear portion 38.

The drive mechanism for the line guide assembly 32 is preferably provided as a drive train subassembly within a housing 40 formed of injection molded thermoplastic material. The concave rear surface of the face plate 10 behind the track 14 provides a channel 42 for receiving the housing 40. The drive train includes an endless flexible belt 44 trained around top and bottom idler pulleys 46 and 48 suitably mounted in the housing 40. The belt 44 is driven by a drive pulley 54 which is drivingly connected to a low voltage DC motor 52 by a splined drive shaft. Pulleys 50 and 51 on either side of the drive pulley 54 assure the necessary frictional engagement of the belt 44 with the pulley 54.

Preferably, the belt 44 is formed from a material having some degree of elasticity, such as polyurethane impregnated fabric, for example. During assembly, the belt is stretched around the pulleys 46, 48, 50, 51, and 54, to provide sufficient tension to assure a driving frictional engagement between the belt 44 and the drive pulley 54.

Figure 4:
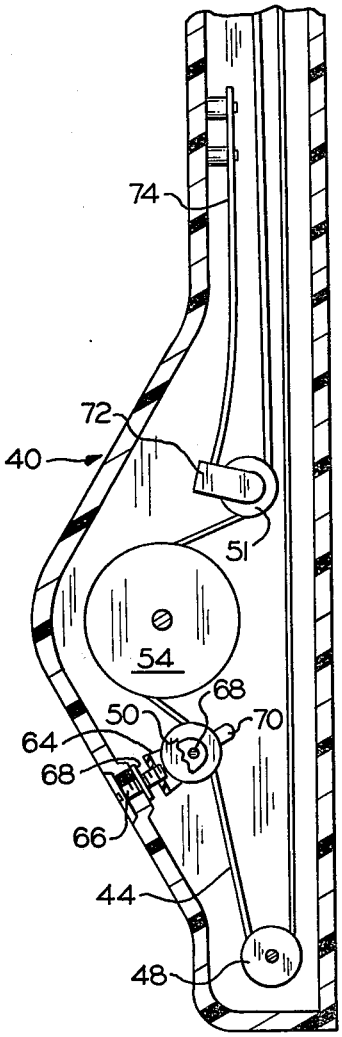
FIG. 4 is a sectional view of a portion of the drive train subassembly, showing in detail the arrangement of the tensioner pulleys.

If the belt is fabricated of a relatively inelastic material, for example, a nylon polyester laminate, means to tension the belt 44 are provided. As illustrated in FIG. 4, the pulleys 50 and 51, which would be rotatably mounted in a fixed position relative to the housing 40 in the case of an elastic belt, are adjustably mounted to provide the necessary tension.

The tensioner pulley 50 is rotatably mounted on a yoke 64 which is shiftably mounted on the housing 40 by a screw 66. The screw 66 is rotatable within the housing 40 and axially fixed relative thereto by the screw head outside the housing and by a snap ring 68 mounted on the screw shaft flush with the inside surface of the housing 40. The yoke 64 is prevented from rotating by engagement of the ends of the pulley spindle 68 in grooves 70 formed on the inside surface of the housing 40 and parallel to the axis of the screw 66. Thus when the screw 66 is rotated from outside the housing 44, the tensioner pulley 50 moves axially along the threaded shaft of the screw 66, thereby increasing or decreasing the tension on the belt 44.

If adjustability of the belt tension is not required, a system such as that shown associated with the tensioner pulley 51 may be employed. The pulley 51 is carried on a yoke 72 which is in turn attached to the housing 40 by a resilient leaf 74. The leaf 74 biases the pulley 51 towards the belt 44, thereby extering a constant tension on the belt 44.

The line guide holder 22 is attached to the belt 44 by means of a bracket 60, formed of stamped sheet metal, for example. As clearly illustrated in FIG. 2, the housing 40 includes a longitudinal slot 78 formed adjacent the edge of the face plate 10. The slot exposes an edge of the adjacent run of the belt 44 within the housing 40. The bracket 60 extends through the slot 58 to grip the belt 44 between resilient tines 62 of the bracket 60. The bracket 60 is secured to the outer leg 28 of the holder 22 by any suitable fastening means.

A power cord 80 connects the motor 52 to a DC power source, preferably housed with a foot operated control switch. When the motor 50 is actuated, the belt 44 is driven, thereby shifting the line guide 32 along the face plate 10. The motor 52 may be actuated by a simple on/off switch operated by the typist. Preferably, however, electronic control means are provided in the circuit between the control switch and the motor 52, whereby any momentary closing of the switch will cause the motor 52 to be actuated for a pre-selected interval, thereby to move the line guide a pre-selected distance along the copy sheet.

Figure 6:
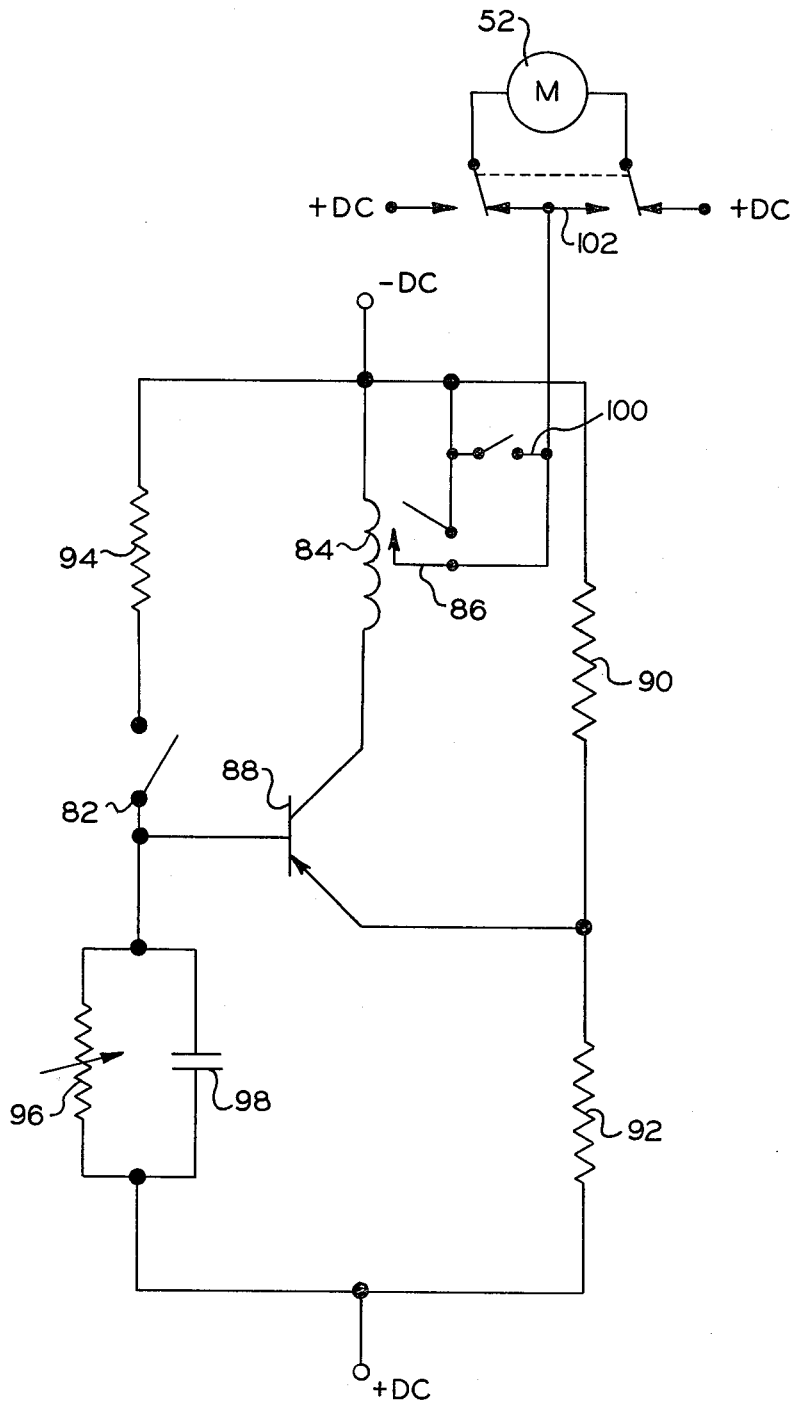
FIG. 6 is a schematic drawing of the electronic control circuitry for operating the drive motor of the copy holder.

The delay circuitry is illustrated in schematic form in FIG. 6. A switch 82 may be adapted to be operated directly by the operator, or automatically in response to the motion of the typewriter carriage. When the switch 82 is momentarily closed, the relay coil 84 is energized, thereby closing the contacts 86 and energizing the motor 52. The coil 84 and the motor 52 remain energized for a predetermined interval after the switch 82 is opened.

The circuitry will now be described in detail. The coil 84 is connected between the negative terminal of 12 volt DC source and the collector of a PNP transistor 88. A bias resistor 90 is connected between the negative terminal of the power source and the emitter of the transistor 88. A bias resistor 92 is connected between the emitter of the transistor 88 and the positive terminal of the power source. A resistor 94 is connected between the negative terminal of the power supply and one side of the switch 82. The other side of the switch 82 is connected to the base of the transistor 88. A variable resistor 96 and a capacitor 98 are connected in parallel between the base of the transistor 88 and the positive terminal of the voltage source.

While the switch 82 is open, the base is at a maximum positive voltage, and the transistor 88 does not conduct. When the switch 82 is momentarily closed, the capacitor charges, and the voltage at the base of the transistor 88 swings toward the negative. When the base voltage is sufficiently negative, the transistor 88 turns on, and current through the emitter-collector circuit energizes the relay coil 84. Typically, the variable resistor 96 is larger than the resistor 94, so that the capacitor 98 charges quickly and the transistor 88 turns on quickly in response to the closing of the switch 82. When the switch 82 is reopened, the capacitor 98 begins to discharge through the variable resistor 98, but maintains a sufficient negative voltage at the base of the transistor 88 to keep the transistor conducting for a predetermined interval. The rate of discharge of the capacitor 98, and thus the interval of delay until the transistor 88 again turns off, is determined by the setting of the variable resistor 94.

The circuitry described thus maintains the motor 52 energized for a pre-selected interval after the switch 82 is momentarily closed, then reopened. The interval may be varied by adjustment of the variable resistor 96, and will be selected to maintain the motor 52 energized until it has moved the line guide 32 the desired distance along the face plate 10.

As illustrated in FIG. 6, the control circuitry may also comprise a manual operation switch 100 and a motor reversing switch 102. The manual operation switch 100 bypasses the relay contacts 86, thereby permitting operation without the time delay feature. The reversing switch 102 is a double pole, double throw switch by means of which the polarity of the power supply to the motor 52 may be selectively reversed. The reversing switch may be manually operable. Alternately, the switch 102 may be adapted to be automatically tripped when the line guide reaches its limits of travel.

From the foregoing description it may be seen that the invention provides an improved copy holder having an electrically controlled line guide. The novel copy holder includes features advantageous both from a manufacturing and maintenance standpoint and from an operation standpoint. The provision of the drive mechanism in a separately housed subassembly and the use of simple, non-magnetic means for attachment of the drive belt to the line guide simplify manufacture and increase reliability. Typing efficiency is enhanced by automatic control means for moving the line guide a pre-selected distance. The control means are readily adaptable to respond to movement of a typewriter carriage, or to manual control.

In accordance with the provisions of the patent statutes, the principal and mode of operation of the apparatus have been explained and what is considered to represent its best embodiment has been illustrated and described. It should, however, be understood that the invention may be practiced otherwise than as specifically illustrated and described without departing from its spirit and scope.

What is claimed is:

1. A copy holder comprising: a face plate defining a generally planar front copy support surface, said face plate provided with a track means extending longitudinally along one marginal edge thereof; a line guide adapted to extend across the copy support surface in a generally perpendicular direction relative to said track means, said line guide having one end positioned adjacent said track means and having an unsupported opposite end; holder means attached to the one end of said line guide and slidably coupled to said track means for permitting longitudinal movements of said holder means and said line guide across the copy support surface while maintaining said line guide in generally perpendicular relationship with said track means; electronic drive means coupled to said holder means for effecting longitudinal movement of said holder means and said line guide across the copy support surface; an elongate housing containing said electronic drive means; and a longitudinally extending channel on the rear surface of said face plate adjacent to and generally parallel with said track means, said channel receiving and retaining said elongate housing.

2. The invention defined in claim 1 wherein said track means includes a longitudinal portion projecting outwardly from the copy support surface and said holder means includes a channel formed therein for receiving the outwardly projecting portion of said track means.

3. The invention defined in claim 2 wherein the outwardly projecting portion of said track means includes a pair of spaced apart, oppositely facing sidewalls and wherein the channel of said holder means includes a pair of spaced apart inwardly facing sidewalls adapted to slidably engage the sidewalls of said track means.

4. The invention defined in claim 1 wherein said electronic drive means includes an endless belt coupled to move said holder means, a motor connected to drive said belt, and control means for controlling said motor to drive said belt and effect longitudinal movement of said holder means and said line guide.

5. The invention defined in claim 4, wherein said drive means includes means for adjusting the tension of said belt.

6. The invention defined in claim 4 including means for automatically maintaining a predetermined tension on said belt.

* * * * *